US010166558B2

(12) United States Patent
Arndt et al.

(10) Patent No.: US 10,166,558 B2
(45) Date of Patent: Jan. 1, 2019

(54) COOLING DEVICE FOR A SPRAYING NOZZLE OR SPRAYING NOZZLE ASSEMBLY WITH A COOLING DEVICE FOR THERMAL SPRAYING

(71) Applicant: Siemens Aktiengesellschaft, Munich (DE)

(72) Inventors: Axel Arndt, Berlin (DE); Uwe Pyritz, Berlin (DE); Oliver Stier, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/127,932

(22) PCT Filed: Mar. 3, 2015

(86) PCT No.: PCT/EP2015/054404
§ 371 (c)(1),
(2) Date: Sep. 21, 2016

(87) PCT Pub. No.: WO2015/139948
PCT Pub. Date: Sep. 24, 2015

(65) Prior Publication Data

US 2017/0100732 A1 Apr. 13, 2017

(30) Foreign Application Priority Data

Mar. 21, 2014 (DE) ..... 10 2014 205 343

(51) Int. Cl.
*B05B 7/14* (2006.01)
*B05B 7/16* (2006.01)

(52) U.S. Cl.
CPC ..... *B05B 7/16* (2013.01); *B05B 7/1486* (2013.01)

(58) Field of Classification Search
CPC ..... B05B 7/16; B05B 7/1486; B05B 7/14
(Continued)

(56) References Cited

U.S. PATENT DOCUMENTS 3,101,384 A * 8/1963 Metz ..... C21C 5/4606 239/132.3
3,856,457 A * 12/1974 Miller ..... F23D 14/22 239/132.3

(Continued)

FOREIGN PATENT DOCUMENTS

CN 101836509 A 9/2010 ..... H05H 1/28
DE 3903887 A1 8/1990 ..... B05B 7/20

(Continued)

OTHER PUBLICATIONS

Sulzer, "Kinetiks™ 4000 Cold Spray Gun," Product Data Sheet, 4 pages, 2013.

(Continued)

*Primary Examiner* — Christopher Kim
(74) *Attorney, Agent, or Firm* — Slayden Grubert Beard PLLC

(57) ABSTRACT

The invention relates to a cooling device for a spraying nozzle, in particular for cold gas spraying, and to a spraying nozzle assembly equipped with such a cooling device. The spraying nozzle is surrounded by an enclosure forming the cooling device, wherein it is provided according to the invention that a cooling line within the enclosure forms a closed system which can be supplied with a cooling medium by way of an inlet and an outlet. The cooling medium therefore advantageously does not come into contact with the spraying nozzle, which is inserted into a receiving opening in the enclosure by means of a loose fit. The closure may also advantageously taper conically towards the mouth of the spraying nozzle, and therefore coatings can also be (Continued)

applied to difficultly accessible components by means of the spraying nozzle assembly according to the invention.

9 Claims, 3 Drawing Sheets

(58) Field of Classification Search
USPC ..... 239/132–132.3
See application file for complete search history.

(56) References Cited

U.S. PATENT DOCUMENTS

| | | | | |
|---|---|---|---|---|
| 5,014,915 A | | 5/1991 | Simm et al. | 239/79 |
| 5,165,705 A | | 11/1992 | Huhne | 239/79 |
| 5,467,925 A | * | 11/1995 | Riano | F23D 11/36 239/132.3 |
| 5,897,059 A | | 4/1999 | Muller | 239/132.3 |
| 2011/0284502 A1 | | 11/2011 | Krink et al. | 219/121.5 |

FOREIGN PATENT DOCUMENTS

| | | | | |
|---|---|---|---|---|
| DE | 4440323 A1 | 5/1996 | | B05B 7/16 |
| DE | 102009052970 A1 | 5/2011 | | B05B 1/00 |
| EP | 0844020 A2 | 5/1998 | | B01F 5/18 |
| GB | 2218013 A | 11/1989 | | B05B 7/20 |
| WO | 2015/139948 A1 | 9/2015 | | B05B 7/14 |

OTHER PUBLICATIONS

German Office Action, Application No. 102014205343.9, 7 pages, dated Oct. 30, 2014.
International Search Report and Written Opinion, Application No. PCT/EP2015/054404, 18 pages, dated May 21, 2015.
Chinese Office Action, Application No. 201580011128.0, 7 pages, dated Mar. 28, 2018.

* cited by examiner

COOLING DEVICE FOR A SPRAYING NOZZLE OR SPRAYING NOZZLE ASSEMBLY WITH A COOLING DEVICE FOR THERMAL SPRAYING

CROSS-REFERENCE TO RELATED APPLICATIONS

This application is a U.S. National Stage Application of International Application No. PCT/EP2015/054404 filed Mar. 3, 2015, which designates the United States of America, and claims priority to DE Application No. 10 2014 205 343.9 filed Mar. 21, 2014, the contents of which are hereby incorporated by reference in their entirety.

TECHNICAL FIELD

The invention relates to a cooling device for a spraying nozzle which is suitable for thermal spraying (also abbreviated to nozzle below). The invention further relates to a spraying nozzle assembly having such a cooling device in which a spraying nozzle is integrated. The cooling device is constructed as a covering, wherein the spraying nozzle can be arranged in the inner space thereof. The cooling device further has an inlet and an outlet for a cooling fluid with which the cooling device can be operated. This cooling fluid may be liquid (for example, water) or gaseous (for example, air).

BACKGROUND

A cooling device or spraying nozzle assembly of the type set out in the introduction is known. For example, the company Sulzer Metco provides for cold gas spraying under the protected trade name "Kinetics 4000 Cold Spray Gun" a spraying nozzle assembly in which the spraying nozzle is surrounded by a pipe. Between the spraying nozzle and the pipe, there is produced an annular gap through which it is possible to direct cooling air which flows from an inlet in the converging portion of the nozzle to an outlet at the nozzle mouth. The cooling air in this instance passes directly over the outer side of the spray nozzle, wherein the absorption capacity of the gaseous cooling medium for the heat discharged from the spraying nozzle is comparatively limited.

SUMMARY

One embodiment provides a cooling device for a spraying nozzle which is suitable for thermal spraying, wherein the cooling device is constructed as a covering in the inner space of which the spraying nozzle can be arranged, the cooling device has an inlet and an outlet for a cooling fluid, wherein the inner space of the covering is constructed as a fitting face which extends at least over a significant portion of the longitudinal extent of the covering, wherein when the spraying nozzle is assembled in the inner space a fit is formed between the spraying nozzle and the covering and there is provided in the covering a cooling line which has a closed cross-section and which connects the inlet to the outlet.

In one embodiment, the covering is constructed from two half-shells, wherein a separation line extends between the half-shells in the direction of the longitudinal extent of the covering.

In one embodiment, each of the half-shells has an independent cooling line with a separate inlet and a separate outlet.

In one embodiment, the inner space of the covering has a lining for compensation of thermal expansion differences between the spraying nozzle and covering.

In one embodiment, the inner space of the covering has a lining acting as an adapter for spraying nozzles with smaller diameters.

In one embodiment, the inlet and the outlet are arranged at the end of the covering which is opposite the mouth of the fitted spraying nozzle.

In one embodiment, the covering is constructed in a frustoconical manner at the end which is located at the side of the mouth of the fitted spraying nozzle.

In one embodiment, the covering is constructed from two shells which are located one inside the other, an inner shell in whose outer covering face the volume of the channels which form the cooling line are introduced and an outer shell which is positioned on the outer covering face of the inner shell and which closes the cross-section of the channels in an outward direction.

In one embodiment, the cooling line has at least partially a constant cross-section and extends in a meandering manner in the covering.

Another embodiment provides a spraying nozzle assembly having a cooling device, wherein the cooling device is constructed as a covering in the inner space of which a spraying nozzle is arranged, the cooling device has an inlet and an outlet for a cooling fluid, wherein the inner space of the covering is constructed as a fitting face which extends at least over a significant portion of the longitudinal extent of the covering, wherein a fit is formed between the spraying nozzle and the covering in the inner space and there is provided in the covering a cooling line which has a closed cross-section within the covering and which connects the inlet to the outlet.

In one embodiment, the spraying nozzle assembly includes a convergent/divergent cross-section path, in particular it is a cold spraying nozzle.

In one embodiment, the spraying nozzle assembly is produced from a hard metal or a ceramic material.

BRIEF DESCRIPTION OF THE DRAWINGS

Example aspects and embodiments of the invention are described below with reference to the drawings, in which.

DETAILED DESCRIPTION

Figure 1:
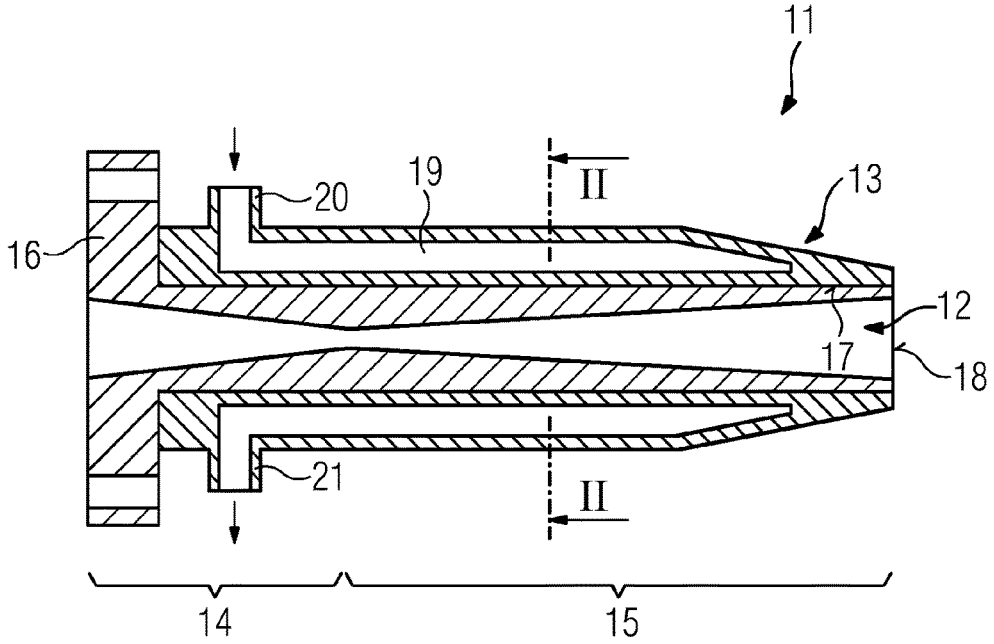
FIGS. 1 and 2 are a longitudinal section and a cross-section of an embodiment of the spraying nozzle assembly according to the invention with an embodiment of the cooling device according to the invention, respectively.

Embodiments of the invention provide a cooling device for a spraying nozzle for thermal spraying or a spraying nozzle assembly with such a cooling device by means of which effective cooling of the spraying nozzle is possible without limitations for the safety or versatility of the operation of the cold spraying nozzle having to be accepted.

Some embodiments provide a cooling device set out in the introduction in that the inner space of the covering is constructed as a fitting face which extends at least over a significant portion of the longitudinal extent of the covering, wherein when the spraying nozzle is assembled in the inner space a fit is formed between the spraying nozzle and the covering. This measure advantageously leads to the spraying nozzle being able to be fitted in the covering and a direct heat transfer being able to be carried out between the material of the spraying nozzle and the material of the covering. In this instance, it is advantageously possible to select for the covering a material which on the one hand ensures good heat discharge and, on the other hand, has a high thermal capacity. Metal materials are particularly suitable, wherein copper is the preferred material. This combines the requirements set out above with a favorable purchase price and good workability. As a result of the spraying nozzle being placed in the covering, the spraying nozzle assembly according to the invention is obtained. The developments and advantages described below apply in equal measure to the cooling device and spraying nozzle assembly according to the invention since the cooling device forms an integral component of the spraying nozzle assembly.

The extent of the fitting face of the covering at least over a significant portion of the longitudinal extent of the covering ensures that an adequate face is provided for a heat transfer from the fitted spraying nozzle to the covering. A significant portion in the context of the invention is intended to be understood to be a longitudinal proportion of more than two-thirds. Preferably, the longitudinal proportion is intended to have from 90 to 100% of the length of the covering. It is further advantageous for the length of the covering in relation to the length of the spraying nozzle, which is also intended to be embedded, to also promote a good thermal transfer. This is the case when the covering covers a significant portion of the spraying nozzle, that is to say, at least two-thirds of the length, preferably even from 90 to 100% of the length.

Since a cooling of the material of the spraying nozzle is carried out according to the invention by means of a heat transfer to the material of the covering, it is advantageously possible to use a cooling fluid for indirect cooling of the spraying nozzle. This is achieved according to the invention in that there is provided in the covering a cooling line which has a closed cross-section and which connects the inlet to the outlet. In this manner, there is advantageously produced a closed system which can advantageously be reliably sealed at the inlet and outlet using conventional means. Since the cooling line is closed inside the covering, that is to say, no wall portions of the cooling line are formed by the surface of the spraying nozzle, leakages cannot occur at the transition location between the covering and spraying nozzle. For this reason, it is possible, for example, to use, without any concessions in terms of the process reliability, liquid cooling fluids by means of which a significantly higher cooling power can be achieved. It is also possible to use a gaseous fluid which is under a higher pressure. The cooling power can thereby also advantageously be increased.

According to one embodiment, the covering may be constructed from two half-shells, wherein a separation line extends between the half-shells in the direction of the longitudinal extent of the covering. This means that the covering can advantageously be taken apart, whereby the spraying nozzle can be placed in a simple manner in the covering. Subsequently, the covering is closed again. It is advantageous in this instance that production tolerances can be better compensated for, for example, by the use of a filling material in the joint gap. It is therefore also possible to select generous clearance fits for the construction of the fitting face, whereby the production complexity is advantageously decreased. In this instance, it should also be taken into account that the diameter of the spraying nozzles used can vary for reasons relating to production, in particular when the spraying nozzles are produced from a hard metal, such as tungsten carbide cobalt, or a ceramic material, such as silicon carbide.

In one construction of the covering from half-shells, each of the half-shells has an independent cooling line with a separate inlet and a separate outlet. This has the advantage that in both half-shells a closed system of the cooling line from the inlet to the outlet can be provided, without a transfer of the cooling fluid between one half-shell and the other half-shell having to be produced.

According to another embodiment, the inner space of the covering may have a lining for compensation of thermal expansion differences between the spraying nozzle and covering. It is thereby advantageously possible to increase the efficiency of the cooling since a mechanical contact between the material of the spraying nozzle and the material of the covering can be ensured by means of the lining. In this instance, the thermal conductivity is improved if it is compared with a variant in which, in accordance with the thermal expansions of the spraying nozzle and covering, an air gap can be produced. On the other hand, by means of the thermal expansion coefficient of the lining, it is also advantageously at least partially possible to prevent tensions from being produced in the connection between the covering and spraying nozzle as a result of the spraying nozzle expanding to a greater extent than the fitting face as a result of the thermal expansion of the covering when the thermal coefficient of the lining is lower than that of the covering.

In the configuration of the covering and where applicable the lining, the process parameters of the ongoing spraying method are intended to be taken into account. On the one hand, the spraying nozzle as a result of the heating is subjected to a degree of expansion, but which is in many cases less than the thermal expansion of the covering when this is constructed of metal. However, it should also be taken into account that the spraying nozzle becomes heated more powerfully than the covering from which the heat is further discharged by means of the cooling fluid. Whether these effects are compensated for or can advantageously be compensated for by the selection of a suitable material for the lining is dependent on the temperatures which occur in the corresponding application.

The lining may be constructed as a separate component so that it can be placed in an intermediate space which is formed when a rough clearance fit is provided between the covering and the spraying nozzle. It is also possible to construct the lining as a fixed component of the covering. This is then securely connected to the inner space of the covering and itself forms the fitting face for the spraying nozzle. In this instance, it would be possible, for example, to select a fit which permits only a small clearance between the covering (with integrated lining) and the spraying nozzle. It would also be possible to select a transition fit which, when the entire tolerance range of the fit is used, could even be constructed without clearance.

In one embodiment, the lining can also use the function of an adapter for spraying nozzles with smaller diameters. In this instance, the production of a construction kit is conceivable. A specific covering with a sufficiently large inner diameter can advantageously be produced in large batch numbers, wherein the inner space is configured with respect to the nozzle with the largest diameter. If spraying nozzles with a smaller diameter are used, the excessively large intermediate space which is produced in this instance between the fitting face of the covering and the outer wall of the nozzle is bridged with a suitable lining.

It may be advantageous for the inlet and the outlet to be arranged at the end of the covering which is opposite the mouth of the fitted spraying nozzle, that is to say, faces away therefrom. This has the significant advantage that the mouth of the spraying nozzle as a result of use of the covering becomes only insignificantly larger with respect to its required structural space. This is primarily significant when the components which are intended to be coated with the spraying nozzle themselves have a complex geometry with zones which are difficult to access. In these cases, the accessibility of the regions which are difficult to reach is directly dependent on how far the spraying nozzle can be moved toward the component. This is possible in a simpler manner with a mouth of the spraying nozzle with a smaller diameter. At the same time, the covering can nonetheless be moved as far as the nozzle mouth in order to ensure an optimum cooling thereof.

It may be advantageous for the covering to be constructed in a frustoconical manner at the end which is located at the side of the mouth of the fitted spraying nozzle. This means that the covering decreases in terms of its diameter in the direction toward the nozzle mouth, wherein the nozzle mouth extends through the notional truncated cone at the frustoconical face which is located at the missing tip. This frustoconical face can be selected in such a manner that its surface content is only insignificantly larger than the outer diameter of the spraying nozzle at the nozzle mouth. Advantageously, the manageability of the spraying nozzle assembly with the covered nozzle is thereby limited only in an insignificant manner. With the nozzle mouth, in spite of the covering, the spraying nozzle can be moved close to the workpiece to be coated even when the angle of the axis of symmetry of the nozzle with respect to the surface to be coated is not equal to 90°.

In one embodiment, the covering is constructed from two shells which are located one inside the other. In this instance, there is provided an inner shell in whose outer covering face the volume of the channels which form the cooling line are introduced. This may be carried out, for example, by means of milling in the surface of the inner shell. It is also conceivable for a cast member to be used. Furthermore, there is provided an outer shell which is positioned on the outer covering face of the inner shell and which closes the cross-section of the channels in an outward direction. This bush may, for example, be produced in a simple manner by means of a tubular semi-finished product. With a structure of the covering comprising two half-shells, longitudinally divided pipe shells are accordingly used for the outer shell. With the construction which is further formed according to the invention, it is possible to produce cost-effectively complex guiding arrangements of the channel which forms the cooling line, wherein, when the channel is guided, extensive coverage of the covering can be produced with the cooling line.

For example, it is possible for the cooling line to have at least partially a constant cross-section and to extend in a meandering manner in the covering. In this instance, the intermediate spaces between the meandering portions of the cooling line are ideally constant so that a uniform cooling profile can be ensured over the extent of the covering. When the cooling line has a meandering path, at least the straight portions can readily be produced with a constant cross-section. Preferably, the portions which extend parallel with the axis of symmetry of the covering can be constructed with a constant cross-section. At the locations at which a direction change of the cooling line in the peripheral direction of the covering is carried out, cross-section changes are acceptable in view of a simpler production. A cooling line with a substantially constant cross-section has the advantage that the cooling fluid is transported through the cooling line with a uniform speed and no regions of stagnation of the cooling fluid can be formed. In such regions of stagnation, the cooling power of the covering would otherwise be reduced.

Other embodiments provide a spraying nozzle assembly, wherein a spraying nozzle is surrounded therein with a cooling device of the type described. The advantages connected with the cooling device used have already been extensively explained.

According to one embodiment, the spraying nozzle assembly may have a convergent/divergent cross-section path, in particular for it to be a cold spraying nozzle. The heating of cold spraying nozzles, in particular in the region of the nozzle throat, presents a problem when using the cold spraying method which can be effectively solved with the covering according to the invention. At the same time, as already explained, the versatile applicability of the cold spraying device does not suffer in this instance, in particular when the covering in the region of the nozzle mouth increases the diameter of the nozzle only by a small amount and inflows and outflows of the cooling device (for the cooling fluid) are fitted to the end of the cooling device facing away from the nozzle mouth.

According to one embodiment, the spraying nozzle assembly may be produced from a hard metal or a ceramic material. In comparison with many metal materials such, as for example, copper, these materials are poor heat conductors so that the heating inside the nozzle cannot be so quickly discharged. However, since these materials are preferably used for reasons of wear behavior of the nozzles, nozzles which are provided with a covering according to the invention benefit in a particular manner from the improved cooling device.

A spraying nozzle assembly 11 has a spraying nozzle 12 which is surrounded by a covering 13. The spraying nozzle 12 is a cold spraying nozzle with a convergent portion 14 and a divergent portion 15, wherein such a nozzle is suitable for accelerating the particles to be processed to a sufficiently great extent that, as a result of the kinetic energy thereof, they remain bonded to the substrate to be coated (not illustrated). The spraying nozzle 12 can be connected using a flange 16 to a cold spraying installation which is not illustrated in greater detail.

Cold gas spraying is a method known per se in which particles which are provided for the lining are accelerated by means of the convergent/divergent spraying nozzle 12, preferably to supersonic speed, so that, as a result of their inherent kinetic energy, they remain bonded to the surface to be coated. In this instance, the kinetic energy of the particles is used and leads to a plastic deformation thereof, wherein the lining particles on impact are melted only at the surface thereof. Therefore, this method in comparison with other thermal spraying methods is referred to as cold gas spraying since it is carried out at comparatively low temperatures at which the coating particles remain substantially fixed. There is preferably used for cold gas spraying, which is also referred to as kinetic spraying, a cold gas spraying installation, which has a gas heating device for heating a gas. There is connected to the gas heating device a stagnation chamber which is connected at the output side to the convergent/ divergent nozzle, preferably a de Laval nozzle. Convergent/divergent nozzles have a converging part-portion (convergent portion 14) and an expanding part-portion (divergent portion 15) which are connected by means of a nozzle neck. The convergent/divergent nozzle produces at the output side a powder stream in the form of a gas flow with particles located therein at a high speed, preferably supersonic speed.

The covering 13 according to FIG. 1 is constructed in one piece, wherein an inner space 17 of the covering is constructed in a cylindrical manner. Since the nozzle 12 is also cylindrical at the outer side, the covering 13 can be readily fitted over the mouth 18 of the spraying nozzle 12. In this case, the inner space 17 forms with the nozzle 12 a clearance fit, which ensures displaceability of the covering 13.

The covering 13 is produced from copper so that a heat discharge from the spraying nozzle 12 into the covering 13 which acts as a cooling member is ensured as a result of the good thermal conductivity of copper. So that the heat can be effectively discharged from the covering 13, the covering has a cooling line 19 which can be supplied with cooling water as cooling fluid via an inlet 20. After the cooling water has flowed through the cooling line 19, it is discharged again via an outlet 21.

Figure 2:
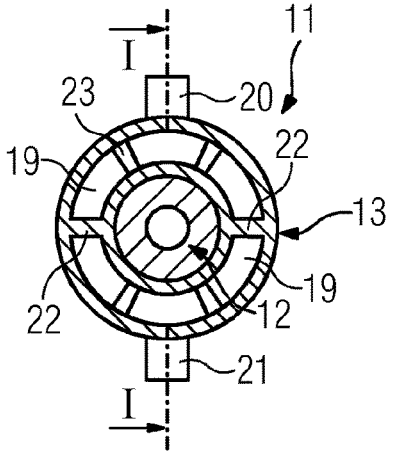

The cross-section of the cooling line 19 can be derived from the cross-section of the nozzle assembly 11 in FIG. 2. The plane of section II-II can be seen in FIG. 1. The plane of section of the longitudinal section according to FIG. 1 is indicated I-I in FIG. 2.

It can be seen that the cooling channel 19 which originates from the inlet 20 takes up the entire upper half of the annular cross-section of the covering 13. In the lower half of this cross-section, the cooling line extends to the outlet 21. In this manner, it is ensured that the cooling fluid is guided in the upper portion of the cooling line as far as the tip of the covering 13, that is to say, the end located at the mouth 18 of the spraying nozzle 12, and a cooling is ensured over the entire length of the covering 13. To this end, there is provided between the upper portion of the cooling line 19 and the lower portion thereof in the covering a partition wall 22 which does not, however, extend as far as the tip of the covering, that is to say, it terminates in front of the plane of the drawing according to FIG. 2 so that the cooling fluid within the annular cross-section can flow from the upper portion of the cooling line 19 into the lower portion.

In order to stabilize the cooling line, there are further provided in the cross-section thereof individual support columns 23, of which in FIG. 2 four can be seen in a state located behind the plane of the drawing. A covering, as illustrated in FIGS. 1 and 2, could be produced, for example, by means of a selective laser melting method.

Figure 3:
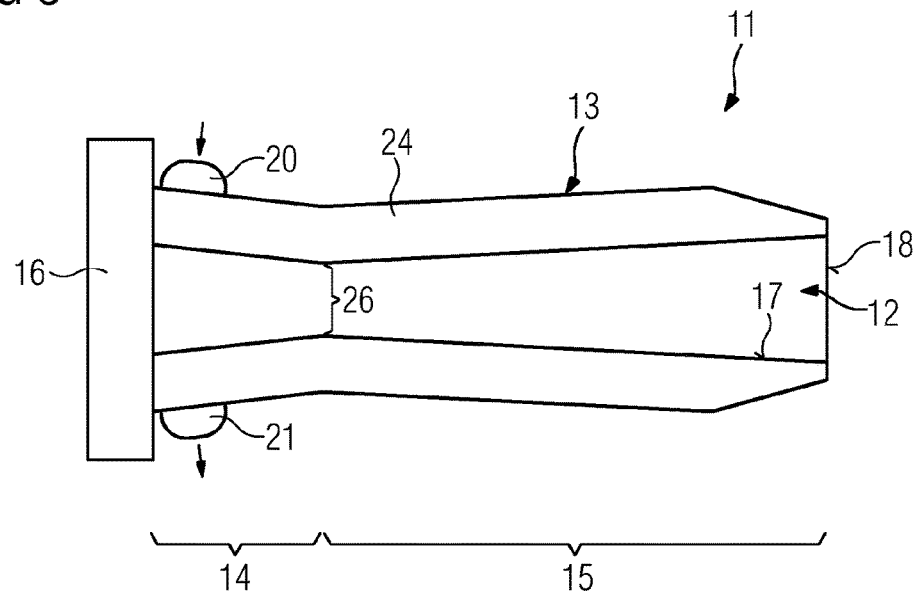
FIG. 3 is a plan view of another embodiment of the spraying nozzle assembly according to the invention with an embodiment of the cooling device according to the invention as a half-shell construction in the open state.

FIG. 3 shows another construction of the covering 13. This has two half-shells, wherein the half-shell 24 can be seen in FIG. 3, whilst the other half-shell is removed from the nozzle 12. For this reason, the nozzle 12 can also be seen in the plan view according to FIG. 3. This is further a precise view of the joint face of the half-shell 24 which, after assembly of the other half-shell, forms a separation line 25 (cf. also FIG. 6). The inlet 20 and the outlet 21 for the cooling fluid can also be seen.

Of the nozzle 12, the convergent portion 14 and the divergent portion 15 can also be seen from the outer side since this nozzle was produced with a constant wall thickness. This has the advantage that in the region of the nozzle throat between the convergent and divergent portion 14, 15 there is no greater wall thickness of the nozzle than at the nozzle inlet and at the mouth 18, the wall thickness thus remains constant over the length of the spraying nozzle 12. Since the material of the spraying nozzle 12 has poor thermal conductivity, the discharge of the heat from the nozzle can thereby be improved since, in the region of the nozzle throat, the heat discharge can also be carried out as quickly as at the nozzle inlet and at the nozzle mouth 18. Since the spraying nozzle has an outer side with a waist 26, the covering 13 has to be constructed from half-shells, which are separated along the extent of the nozzle. For this reason, the covering does not need to be fitted onto the nozzle, but instead can be placed on the nozzle in a radial direction.

Figure 4:
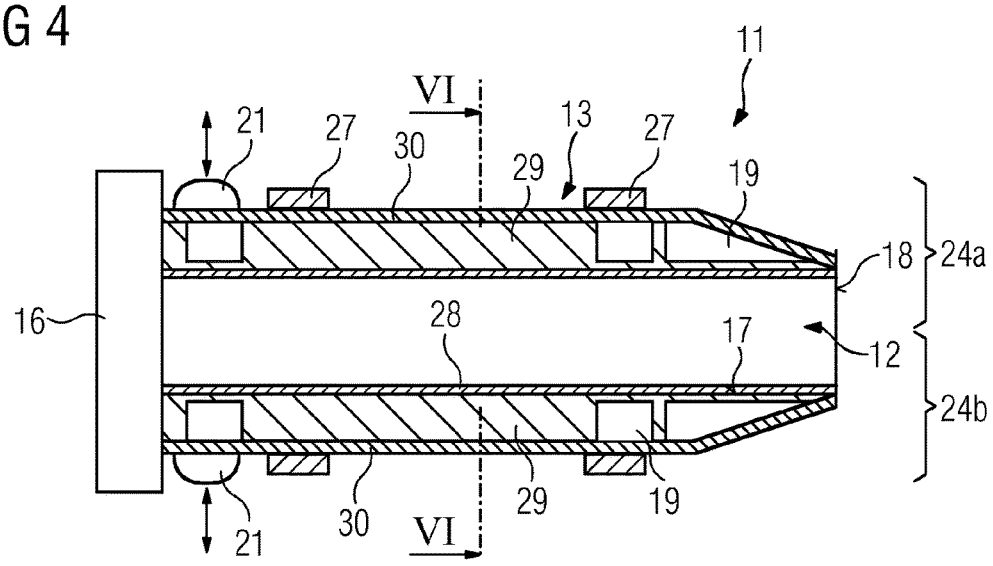
FIGS. 4 to 6 show another embodiment of the spraying nozzle assembly according to the invention with an embodiment of the cooling device according to the invention as a longitudinal section, cross-section and as a developed view of the covering in order to illustrate the path of the cooling line, respectively.
Figure 5:
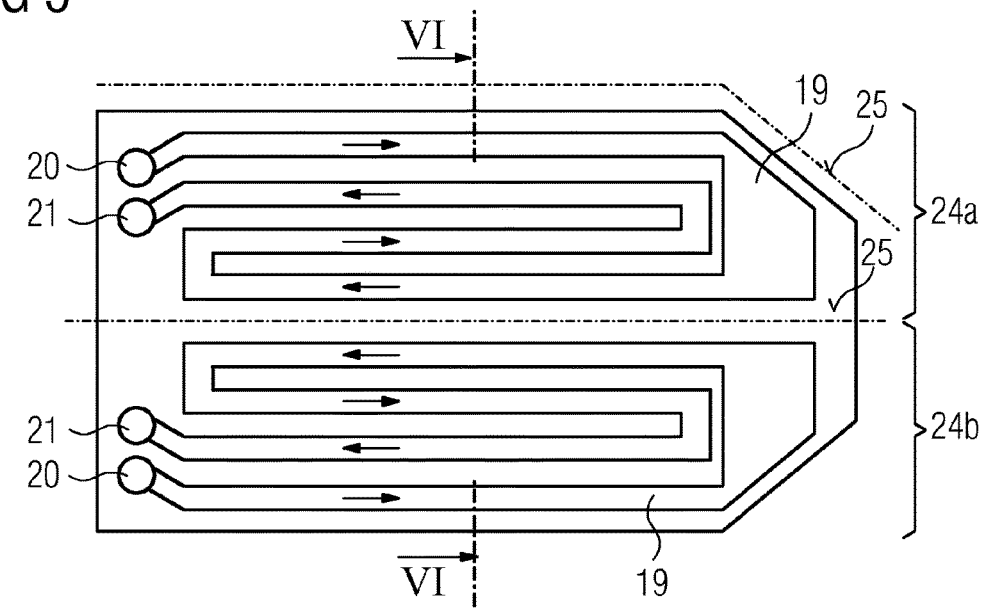
Figure 6:
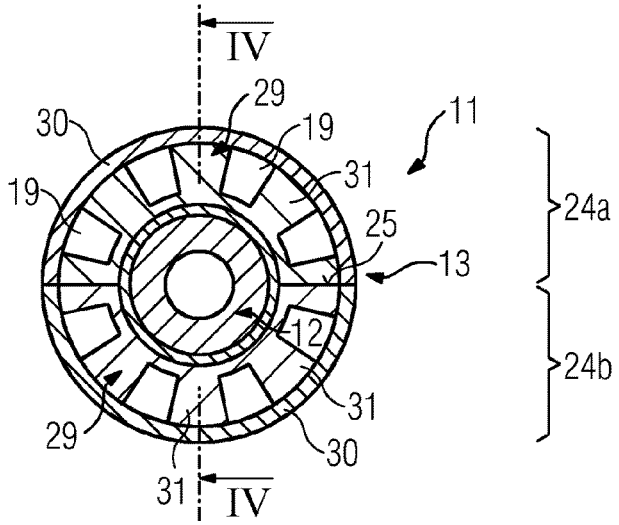

According to FIG. 4, the covering 13 also has two half-shells 24*a*, 24*b*, wherein the separation line extends perpendicularly to the plane of the drawing (cf. also FIG. 6, wherein the section VI-VI according to FIGS. 4 and 5 is illustrated). After the assembly of the covering 13 comprising the half-shells 24*a*, 24*b*, they are held together by means of clamping rings 27. In an intermediate space which is produced as a result of the clearance fit provided between the spraying nozzle 12 and the inner space 17 of the covering, a lining 28 is provided. This may, for example, comprise an aluminum film. This lining improves the heat transfer from the spraying nozzle 12 into the material of the covering 13.

In the half-shells 24*a*, 24*b*, an independent cooling line 19 is provided in each case. In the plane of section IV-IV (cf. FIG. 6), the cooling line is sectioned several times, wherein the precise path of the cooling line 19 can be seen in FIG. 5. Figure illustrates a developed view of the covering 13. It may be considered as if the covering with the cylindrical outer face is bent in a plane. In this plane, the two separation lines 25 can then be seen as dot-dash lines. The bend in one separation line 25 according to FIG. 5 results from the fact that, as a result of the conical tapering of the covering at the mouth 18, there is produced a reduction of the outer diameter of the covering.

As can be seen in FIG. 5, the cooling line 19 has a meandering path. The flow direction of the cooling fluid from the inlet 20 to the outlet 21 of the respective half-shell is indicated with arrows. It can be seen in this instance that the cooling lines according to FIG. 4 constitute sections of the portions of the cooling line which extend in the peripheral direction of the covering. In this manner, the axially extending portions of the cooling line 19, which have a constant cross-section, are connected to each other. In the region of the conical tapering of the covering 13, it appears in the developed view as if the cross-section of the cooling line 19 is larger. However, this is not the case as can readily be seen from FIG. 4 since the reduction of the diameter in the conical region has to be compensated for by the cooling line being wider in an axial direction.

It can be seen in FIG. 6 that the cooling line 19 with the portions thereof in cross-section in the covering 13 are all selected to be the same. They have a rectangular cross-section which is produced by producing milled grooves in an inner shell 29. Since the grooves are open radially outward, it is necessary for the inner shells 30 of the upper half-shell 24*a* and the lower half-shell 24*b* to each be closed by means of outer shells 30. A connection of the joint locations can be carried out by means of soldering or adhesive bonding. However, this materially engaging connection is required only in the regions of the joint locations which have to be sealed outward. The contact faces of the webs 31 located between the grooves with respect to the outer shell 30 do not have to be connected in a materially engaging manner since a slight leakage between adjacent portions of the line 19 is acceptable. The construction comprising the inner shell 29 and outer shell 30 can be seen in FIG. 4.

The invention claimed is:

1. A cooling device for a spraying nozzle which is suitable for thermal spraying, comprising:

a covering with an exterior surface and an inner space configured for arrangement of the spraying nozzle, wherein the covering is constructed from two half-shells and a separation line extends between the half-shells in a longitudinal direction of the covering, an inlet and an outlet for a cooling fluid, wherein the inner space of the covering is constructed as a fitting face in contact with the spray nozzle over at least two-thirds of a longitudinal extent of the covering, wherein when the spraying nozzle is assembled in the inner space a fit is formed between the spraying nozzle and the covering, a lining for the fitting face of the covering, the lining providing an adaptor for dimensional differences between the covering and the spraying nozzle, and a cooling line provided in the covering, the cooling line having a closed cross-section and connecting the inlet to the outlet, a second cooling line, wherein each of the cooling lines feeds into a different one of the two half-shells, and a second inlet and a second outlet, wherein each of the two half-shells is in communication with only one of the two inlets and only one of the two outlets.

2. The cooling device of claim 1, wherein the lining compensates for thermal expansion differences between the spraying nozzle and covering.

3. The cooling device of claim 1, wherein the inlet and the outlet are arranged at an end of the covering opposite a mouth of the fitted spraying nozzle.

4. The cooling device of claim 1, wherein the covering comprises a frustoconical shape at an end located at a side of a mouth of the fitted spraying nozzle.

5. The cooling device of claim 1, wherein:

the covering is constructed from an inner shell located inside an outer shell, the inner shell has an outer covering face in which channels that form the cooling line are introduced, and the outer shell is positioned on the outer covering face of the inner shell and closes a cross-section of the cooling line channels in an outward direction.

6. The cooling device of claim 1, wherein at least a portion of the cooling line has a constant cross-section and extends in a meandering manner in the covering.

7. A spraying nozzle assembly, comprising:

a spraying nozzle, and a cooling device comprising:

a covering with an exterior surface and an inner space in which the spraying nozzle is arranged, an inlet, and an outlet for a cooling fluid, wherein the covering is constructed from two half-shells and a separation line extends between the half-shells in a longitudinal direction of the covering, wherein the inner space of the covering is constructed as a fitting face in contact with at least two-thirds of a longitudinal extent of the covering, wherein a fit is formed between the spraying nozzle and the covering in the inner space, a lining for the fitting face of the covering, the lining providing an adaptor for dimensional differences between the covering and the spraying nozzle, and a cooling line provided in the covering, the cooling line connecting the inlet to the outlet and having a closed cross-section within the covering, a second cooling line, wherein each of the cooling lines feeds into a different one of the two half-shells, and a second inlet and a second outlet, wherein each of the two half-shells is in communication with only one of the two inlets and only one of the two outlets.

8. The spraying nozzle assembly of claim 7, wherein the spraying nozzle comprises a convergent/divergent cross-section path.

9. The spraying nozzle assembly of claim 7, wherein the spraying nozzle assembly is produced from a ceramic material.

* * * * *